US005189989A

United States Patent [19]

Nilsson et al.

[11] Patent Number: 5,189,989

[45] Date of Patent: Mar. 2, 1993

[54] PULSATORY BURNER

[75] Inventors: Jan Nilsson, Falkenberg; Stefan Lundberg, Hammenhög, both of Sweden

[73] Assignee: Pulsonex AB, Halmstad, Sweden

[21] Appl. No.: 809,523

[22] PCT Filed: Aug. 21, 1990

[86] PCT No.: PCT/SE90/00541

§ 371 Date: Jan. 17, 1992

§ 102(e) Date: Jan. 17, 1992

[87] PCT Pub. No.: WO91/02924

PCT Pub. Date: Mar. 7, 1991

[30] Foreign Application Priority Data

Aug. 24, 1989 [SE] Sweden ..... 8902811

[51] Int. Cl.[5] ..... F22B 31/00

[52] U.S. Cl. ..... 122/24; 431/1

[58] Field of Search ..... 122/24; 431/1

[56] References Cited

U.S. PATENT DOCUMENTS

| | | | |
|---|---|---|---|
| 3,252,496 | 5/1966 | Haag | 122/24 X |
| 3,267,985 | 8/1966 | Kitchen | 122/24 X |
| 4,488,865 | 12/1984 | Davis | 431/1 |

FOREIGN PATENT DOCUMENTS

| | | |
|---|---|---|
| 0107538 | 3/1989 | European Pat. Off. . |
| 933651 | 9/1955 | Fed. Rep. of Germany . |
| 61-52508 | 3/1986 | Japan . |
| 8402762 | 7/1984 | World Int. Prop. O. . |

*Primary Examiner*—Edward G. Favors

*Attorney, Agent, or Firm*—Merchant & Gould Smith, Edell, Welter & Schmidt

[57] ABSTRACT

Pulsatory burner which is mounted in the water room (12) of a hot water boiler comprising a combustion chamber (14) with a neck (17) provided as an air inlet, and a nonreturn valve (18) controlling the air flow through the air inlet to the combustion chamber. An outlet (40, 41) for hot water from the water room (12) is provided around the neck (17) for the cooling thereof.

5 Claims, 2 Drawing Sheets

SUBSTITUTE SHEET

1/2

PULSATORY BURNER

Figure 1:
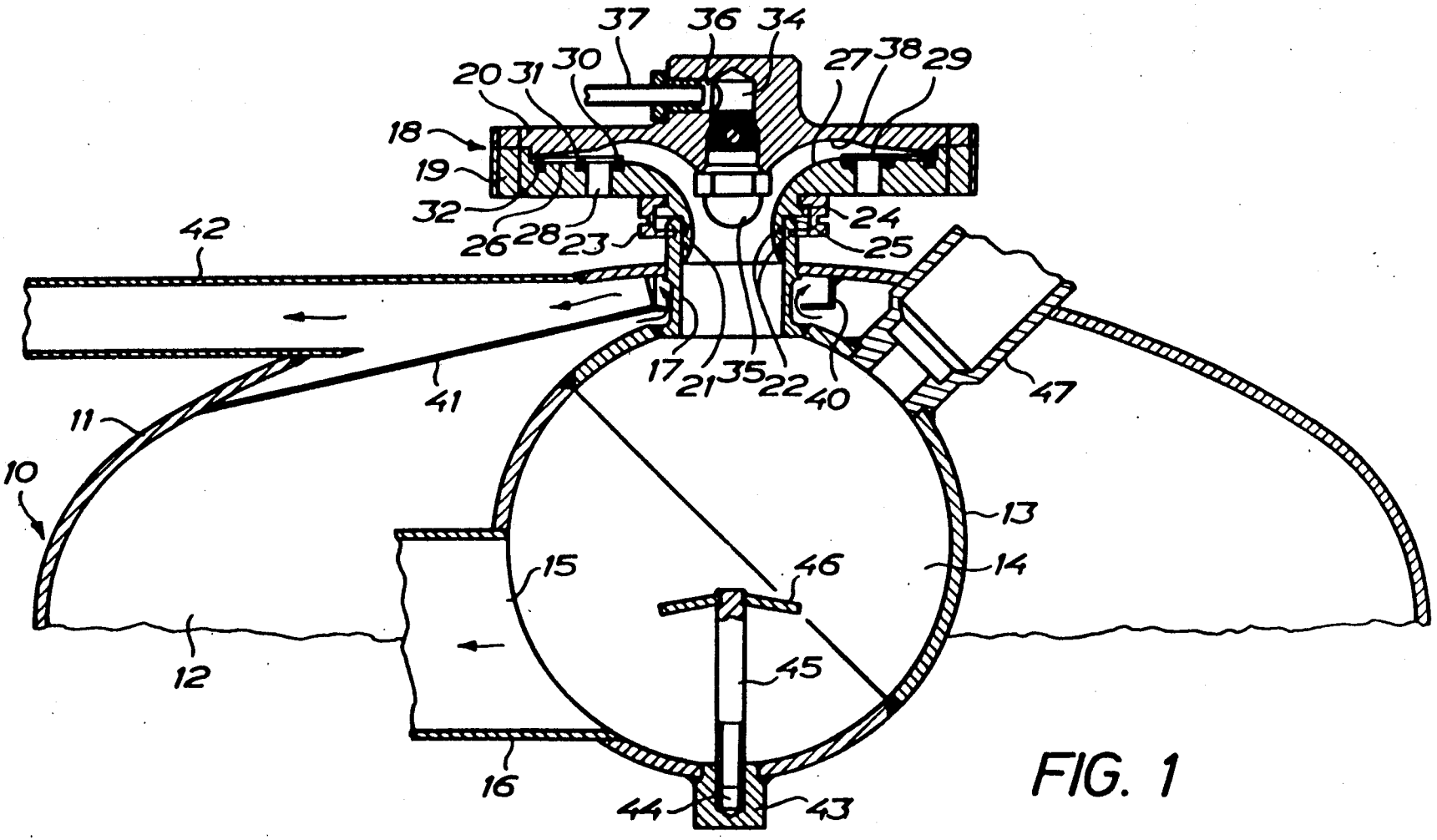

The invention relates to a boiler containing a pulsatory burner which is mounted in the water space of a hot water boiler and comprises a combustion chamber with a neck provided as an air inlet, and a non-return valve controlling the air flow through the air inlet to the combustion chamber, said non-return valve having a seat concentric with the air inlet, wherein there is provided at least one air inlet opening, and a flat, relatively think circular valve ring which is elastically flexible and, in the closed position of the valve, engages the seat and keeps the air inlet opening closed but can be operated to an open position by depression in the combustion chamber.

DE-C-933 651 discloses a boiler comprising a pulsatory burner consisting of a combustion chamber with a neck provided as an air inlet and a non-return valve controlling the air flow through the air inlet to the combustion chamber.

SE-B-435 098 shows how the non-return valve can be constructed and how the air inlet can be provided in a pulsatory burner of the above-mentioned type. The valve seat then consists of a flared portion at one end of the neck, the other end thereof being connected to the combustion chamber. The neck bears a valve body in which the seat and the valve ring are provided, and in the neck a fuel injection nozzle having ignition electrodes is provided. It is noted that the neck has a considerable axial length, and the reason therefore is that the non-return valve shall be spaced from the combustion chamber to avoid contamination and formation of coke on the valve seat. Then, also the injection nozzle will be at a relatively large distance from the combustion chamber, which is favourable since as a consequence thereof it will be subjected to contamination and exposed to heat radiation from the combustion chamber to a smaller extent but, on the other hand, due to such a location of the nozzle a bad fuel distribution in the combustion chamber will be obtained.

The most serious disadvantage of the provision of a long neck as in the known embodiment is, however, that the air inlet represents a dead volume in the combustion chamber, i.e. a volume which is not necessary for the combustion proper. By the dead volume being large, the movement of the valve ring will not occur as quickly and distinctly as desired. The opening period for the non-return valve becomes relatively long, and when the non-return valve is open back flow of gas from the combustion chamber can occur through the air inlet, dust (soot) being transported up to the valve seat and the valve disk causing contamination thereon. When the non-return valve does not work distinctly, the function of the burner becomes unreliable.

The purpose of the invention is to eliminate or at least considerably reduce the said disadvantages by reducing the dead volume of the combustion chamber and locating the non-return valve closer to the combustion chamber.

According to the invention the pulsatory burner of the above-mentioned type for this purpose has obtained the characterizing features of claim 1.

By passing water which is drawn off from the water space of the boiler along the outside of the neck of the combustion chamber, said neck will be cooled. The oil which is ejected into the neck from the fuel injection nozzle then will be kept so cold in the neck, due to the cooling thereof, that the oil will not be vaporized on the wall of the air inlet with following formation of coke. The zone where the vaporization of the oil will take place has been moved down into the combustion chamber to the inside of the top of the combustion chamber where the formation of coke will not cause any trouble; existing coke is removed by vibration and/or burning. The dead volume which is reduced by the arrangement of a shorter neck makes possible a quick and distinct movement of the valve ring and a lower location of the fuel nozzle and thus a more favourable distribution of the fuel in the combustion chamber.

Figure 2:
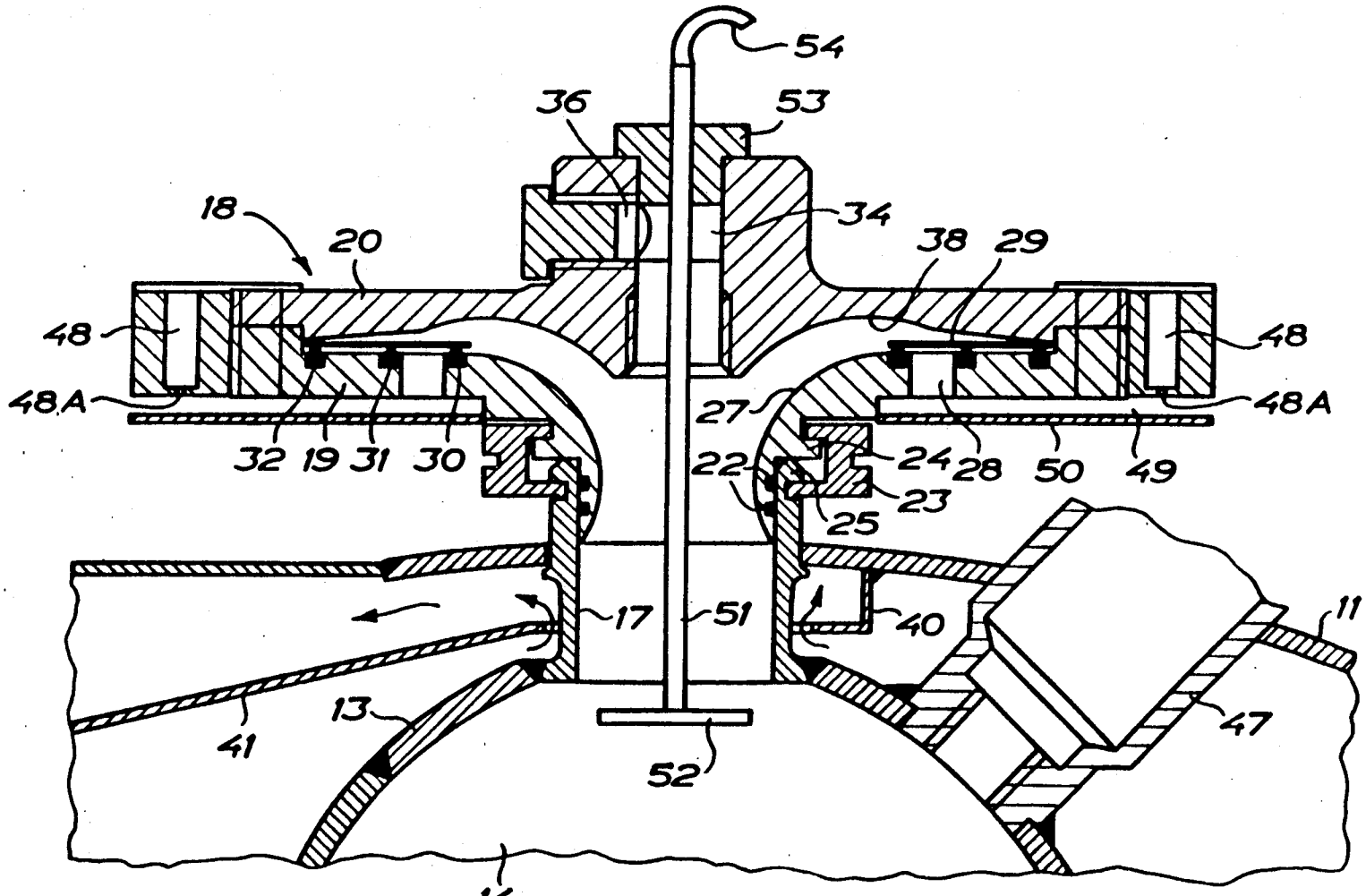

For further explanation of the invention embodiments thereof are described below reference being made to the enclosed drawings in which FIG. 1 is a vertical cross sectional view of a pulsatory burner according to the invention provided in the partly shown water space in a hot water boiler, and FIG. 2 is a fragmentary vertical cross sectional view of the pulsatory burner modified for the use of gas.

In FIG. 1 a hot water boiler 10 with a water space 12 formed by a tank 11 is fragmentarily shown, a pulsatory burner 13 being provided in the water space. The pulsatory burner comprises a spherical combustion chamber 14 having an opening 15 which is connected to a flue gas outlet by a conduit 16, said flue gas outlet forming a Helmholz-resonator together with the combustion chamber, and further having a cylindrical neck 17 provided on the top thereof, which is attached to the wall 11 and supports a non-return valve 18. This valve comprises a valve body which consists of a lower part 19 and a cover 20 which are detachably connected by means of bolt joints. The lower part is inserted into the neck 17 at a cylindrical socket 21, sealing O-rings 22 being provided between the socket and the neck, and the lower part being attached to the neck 17 by means of a snap-in lock 23 which engages outwardly projecting flanges 24 and 25 on the lower part and on the neck, respectively. The lower part forms a circular valve seat 26 which joins the socket 21 at a curved interior surface portion 27 which joins the cylindrical interior surface of the neck 17.

In the seat a number of air inlet openings 28 are provided, and for the control of the air flow therethrough a relatively thin, circular valve ring 29 is provided which has to be elastically flexible and can consist of metal, or plastic, or some composite material. The openings 28 are distributed along a circle, and on both sides of the openings elastic O-rings 30 and 31 are provided which are received in annular grooves in the seat. Close to the circumference of the valve ring an O-ring 32 is also provided which is received in an annular groove in the seat, and the outer edge of the valve ring is received between the cover 20 and this latter O-ring. The cover forms a centrally projecting cylindrical portion on the upper side thereof with a downwards open central threaded bottom hole 34 into which an injection nozzle 35 is screwed, and to the bottom hole 34 a threaded cross bore 36 connects for the connection of a conduit 37 for supply of fuel oil (FIG. 1). The injection nozzle extends centrally into the socket 21 and opens into a constriction in the passage through the socket, formed by the surface 27, which forms a kind of a venturi nozzle.

The cover 20 has on the lower side thereof a ring shaped recess which is bounded by a curved surface 38 the shape of which is adapted to the shape of the curved surface 27 so that, around the injection nozzle 35, there is a ring shaped passage which extends from the air inlet openings 28 down into the neck 17 which forms the air inlet to the combustion chamber.

Inside the water space 12 quite close to the wall 11 the neck is surrounded on the outside thereof by a downwards open cover 40 which is connected to a conduit 41 provided along the wall 11, a tube 42 for output hot water from the boiler being connected to said conduit. The water which is heated in the water space 12 of the boiler by means of the pulsatory burner is thus forced to pass into the radiator system through the tube 42 in contact with the outside of the neck 17 inside the cover 40 in order that this water will cool the neck, which is made relatively short as disclosed in FIG. 1.

Diametrically opposite to the neck 17 on the lower side of the combustion chamber there is provided a socket 43 with a threaded bore 44 into which a stud 45 is screwed which projects into the combustion chamber towards the centre thereof but ends at a distance therefrom. In the inner end thereof the stud supports a plate 46 shaped as a truncated cone with the small end upwards. The plate should consist of a heat resistant material. Thus, the oil which is ejected from the injection nozzle 35 is directed into the combustion chamber against this plate which serves as an ignition body for the oil. Previously, a plate of cast iron has been provided as an ignition body. Such a plate has a large thermal inertia and takes a long time to be hot. The consequence thereof is that poor combustion after starting of the pulsatory burner is obtained (the boiler smokes). Furthermore, the construction is expensive and provides a non-desired heat radiation towards the non-return valve.

On the combustion chamber there is also provided a casing 47 for the mounting of an ignition electrode.

In order to create optimal conditions for the combustion in the pulsatory burner when this is made with a water cooled short neck 17 in the way described above, the dimensioning of the pulsatory burner is critical. Thus, critical parameters are the ratio between the internal diameter of the neck 17 and the internal diameter of the combustion chamber 14, the ratio between the diameter of the plate 46 and the internal diameter of the combustion chamber, and the ratio between the distance from the plate 46 to the top of the combustion chamber and the internal diameter of the combustion chamber. Also the distance from the tip of the injection nozzle to the combustion chamber has significance.

For a combustion chamber with an internal diameter of 130 mm the following exemplifying numbers can be given:

The diameter of the plate 46 can be between 20 and 60 mm which gives a ratio between the diameter of the plate and the internal diameter of the combustion chamber ranging from 0.15 to 0.46.

The distance from the top of the plate 46 to the top of the combustion chamber can be 64–85 mm which gives a ratio between this distance and the internal diameter of the combustion chamber ranging from 0.49 to 0.65.

The internal diameter of the neck 17 (the diameter of the air inlet) can be between 20 and 60 which gives a ratio between this diameter and the internal diameter of the combustion chamber between 0.15 and 0.35.

The distance between the nozzle tip and the combustion chamber should be 10–35 mm which corresponds to a ratio between this distance and the internal diameter of the neck of 0.17–1.75.

The function of the pulsatory burner is well known and, therefore, will not be further described since the pulsatory burner described herein as to the method of functioning does not differ in principle from previously known pulsatory burners of the type referred to herein. The valve ring 29 opens and closes under the influence of the phases of positive and negative pressure which are obtained in connection with the pulsatory combustion in the combustion chamber. Optimization of the combustion conditions requires, in addition to that previously mentioned, that the valve closes abruptly when abutting the valve seat and then seals tightly against the seat. Good sealing against the valve seat can be achieved by the valve ring having a large contact surface against the seat in the closed position which, however, entails a risk for the valve ring to stick to the supporting surface on the valve seat. On the other hand, if the supporting surface on the valve seat is decreased the sealing will be less satisfactory and there is a risk of deformation of the valve ring generating large bending stress therein. In the embodiment of the non-return valve described herein which in principle coincides with that described in SE-B-435 098 as comprising a valve ring which is mounted between two supports at the outer edge thereof, namely between the cover 20 and the O-ring 32, good sealing is achieved against the valve seat at the same time as the risk for the valve ring to stick to the seat is eliminated by the valve ring in the closed position thereof engaging the two O-rings 30 and 31 provided one at each side of the air inlet openings. The allowance between the supports at the outer edge of the valve ring should be as small as possible and should be ranging from 0 to 0.5 mm; at an allowance larger than 0.5 mm the valve will be too slow. In the normal resting position thereof the valve ring engages the O-rings without these being appreciably deformed and therefore the contact surface between the valve ring and the O-ring is thereby small. The valve ring can thus easily be lifted from the O-rings without sticking to them. When the valve ring lands on the O-rings to close again, the O-rings will, however, be deformed under enlargement of the surface contacting the valve ring, which gives a quick and distinct closing.

The described pulsatory burner is constructed for combustion of oil or another liquid fluid but can also be arranged for the combustion of gaseous fuel. In the gas variant the pulsatory burner can be constructed in a manner known per se as shown in FIG. 2.

According to FIG. 2 the pulsatory burner is arranged for the combustion of gas which is supplied through a ring passage 48 provided in the lower part 19 and having a number of uniformly distributed outflow openings 48A which open on the cover side of the lower part into a passage 49 which is defined between the lower side of the lower part and a plate or a panel 50 attached to the lower part. The bore 36 then is plugged. The air to the combustion chamber is aspirated via the non-return valve through this passage the gas being mixed with the aspirated air. In the upper part 20 a so called ignition button 52 made of a heat resistant material is suspended in the combustion chamber by means of a shank 51, said ignition button being located beneath the opening of the inlet passage at a distance of 10–25 mm from the top of the combustion chamber, which corresponds to a ratio between said distance and the internal diameter of the combustion chamber of 0.07–0.2. The shank is attached to the upper part by means of an insulator 53 and is connected by means of a conduit 54 to a flame monitor system. The ignition button, the diameter thereof being 20–30 mm, serves to ignite the inflow of the gas mixture but can also, as shown herein, serve as an electrode for ionization type monitoring of the combustion in the combustion chamber in a way known per se.

If the shank 51 with the ignition button 52 is removed and replaced by an oil nozzle, the pulsatory burner can easily be converted from gas firing to oil firing.

We claim:

1. Boiler containing a pulsatory burner which is mounted in the water space (12) of the boiler, comprising a combustion chamber (14) with a neck (17) provided as an air inlet, a non-return valve (18) controlling the air flow through the air inlet to the combustion chamber, said non-return valve having a seat (26) concentric with the air inlet, at least one air inlet opening (28), a plane, relatively thin circular valve ring (29) which is elastically flexible and, in the closed position of the valve, engages the seat and keeps the air inlet opening closed but can be operated to an open position by depression in the combustion chamber, and an outlet (40, 41) for hot water from the water space (12) said outlet being provided around the neck (17) for the cooling thereof.

2. Boiler according to claim 1, wherein the air inlet in the neck (17) has a circular cross section and the combustion chamber (14) is spherical internally, and wherein the ration between the diameter of the air inlet and the internal diameter of the combustion chamber is of the order of 0.15 . 0.35.

3. Boiler according to claim 1, wherein the air inlet is provided with a constriction bounded by a curved surface (27).

4. Boiler according to claim 1, wherein elastic O-rings (30, 31) are provided in the valve seat (26) on both sides of the air inlet opening or openings (28), respectively, as engagement surfaces for the valve ring (29).

5. Boiler according to claim 1 with a fuel nozzle (35) opening into the air inlet (17), wherein the ratio between the distance from the fuel nozzle to the top of the combustion chamber and the internal diameter of the neck (17) is 0.17–1.75.

* * * * *